United States Patent [19]

Sather

[11] 4,134,247

[45] Jan. 16, 1979

[54] METHOD AND APPARATUS FOR PROVIDING CONTAINERS WITH STRAWS

[76] Inventor: Kenneth E. Sather, 990 Sonora Dr., Reno, Nev. 89502

[21] Appl. No.: 550,992

[22] Filed: Feb. 19, 1975

[51] Int. Cl.[2] ..... B65B 3/00

[52] U.S. Cl. ..... 53/281; 53/239; 426/115; 426/394

[58] Field of Search ..... 426/106, 115, 124, 132, 426/85, 392, 394, 397; 239/16, 33; 220/90.2; 229/7 S; 53/236, 261, 262, 259 R, 281, 239; 215/1 A

[56] References Cited

U.S. PATENT DOCUMENTS

| | | | |
|---|---|---|---|
| 3,038,281 | 6/1962 | Quisel | 53/59 R X |
| 3,325,076 | 6/1967 | Soucy | 229/7 S |
| 3,349,955 | 10/1967 | Cornelius | 229/7 S X |
| 3,717,476 | 2/1973 | Harvey | 426/85 |

FOREIGN PATENT DOCUMENTS

| | | | |
|---|---|---|---|
| 1022157 | 3/1953 | France | 215/1 A |
| 359051 | 1/1962 | Switzerland | 215/1 A |

*Primary Examiner*—William A. Cuchlinski, Jr.
*Attorney, Agent, or Firm*—Herbert C. Schulze

[57] ABSTRACT

This invention is a method and apparatus for performing said method wherein a drinking straw having a flexible section thereof is inserted into a container for fluids, and which is particularly characterized by the use of means for folding the straw about the flexible portion and inserting the same within a liquid filled container prior to the sealing of said container, in such a manner that the straw is angularly disposed so as to be readily accessable on opening of the container.

2 Claims, 16 Drawing Figures

40
41
42
43
44
45
46
50
60
64
73

METHOD AND APPARATUS FOR PROVIDING CONTAINERS WITH STRAWS

CROSS REFERENCE TO RELATED PATENT APPLICATIONS

There are no patent applications filed by me pending at this time and related to this application for patent.

BACKGROUND OF THE INVENTION

1. Field of the Invention

This invention is in the general field of containers for liquids, and particularly containers for liquids wherein the liquid is customarily consumed directly from the container. The invention is more particularly directed to an apparatus and method by which a drinking straw is inserted into the filled container prior to the closure thereof.

2. Description of the Prior Art

For many years attention has been devoted to the problem of providing drinkable fluid containers with a suitable straw or the like to facilitate the convenience and sanitary drinking of the fluid directly from the container upon the same being opened.

I am familiar with many efforts to place straws within containers of different configurations, and the following are some of the more prominent examples of these efforts, some of which have been patented: U.S. Pat. Nos. 3,746,197, issued to me; 2,837,234; 2,748,968; 3,326,695; 1,680,341; 3,291,331; and 3,303,984.

In each case, it will be noted that a special arrangement has been arrived at for a special type container or the like. This is even true of my own patented item heretofore referenced. In each case, due to the difficulties of filling different types of containers with the liquid and due to the difficulty of insertion of a straw in a usable as well as a sanitary manner, a special construction of straw and a container has been embodied.

There is not prior art in the field of a method and apparatus by which straws may be inserted within fluid containers of varying and customary construction utilizing existing filling equipment for the liquids and customary sealing means for the containers the said straw may be inserted in automatic sequence and angularly disposed within the container so as to facilitate retainment of the straw within the appropriate area for easy removal.

SUMMARY OF THE INVENTION

For many years, various individuals and concerns have recognized the desirability and value of a pre-packaged drinking straw inserted within a container of drinking fluid. I also have worked in this field as evidenced by my previously mentioned U.S. Pat. No.: 3,746,197.

As with the others who have studied this field, I found it necessary to provide a special construction in order to satisfactorily achieve the object of providing a drinkable fluid within a container and containing a straw ready to be used conviently upon the opening of the container.

However, I have recognized that for this principle (a straw within a container) to have its maximum economic and practical use it would be necessary somehow to avoid the special constructions of cartons and their cooperative relations with straws which have made the use of pre-packaged straws of limited value up to the present time.

I have now invented and developed a new and unique method by which a drinking straw can be economically packaged within any customary fluid container.

In studying the problem, I reviewed all of the various types of straws utilized by me, in my invention (U.S. Pat. No.: 3,746,197) as well as the others who have been engaged in this field.

I discovered that by utilizing the general type of straw which I previously used, the achieving of this goal was possible by the application of special techniques.

By taking a straw of the general type used by me in my afore-referenced invention, and inserting it into a special holder suitable to cooperate with the opening of the container being used (and after it is filled), I have been able to eliminate the prior difficulties and to provide a straw within a container which maintains, through its own interaction with the container, a position of ready availability.

After the insertion of the straw into a filled container, the normal and customary closure device used in the particular filling operation is employed, without a change.

In my method, a container is first filled with the fluid; a special straw having a flexible section is then inserted into a specially configuered dispensing holder which has the end into which the straw is inserted designed so as to have a cooperative relationship with the open container with which it ultimately operates; thereafter, by suitable means, the straw is ejected into the container in usable configuration, after which the container passes on to its closure machine.

It is an object of this invention to provide a method and apparatus for inserting a drinking straw into any container of a drinkable fluid.

Another object of this invention is to provide such a method and apparatus which may be used in a cooperative relationship with any customary container filling and sealing equipment.

The foregoing and other objects and advantages will be clear to those skilled in the art upon reading the following description of a preferred embodiment in conjunction with a review of the appended drawings.

DESCRIPTION OF A PREFERRED EMBODIMENT

Figure 1:
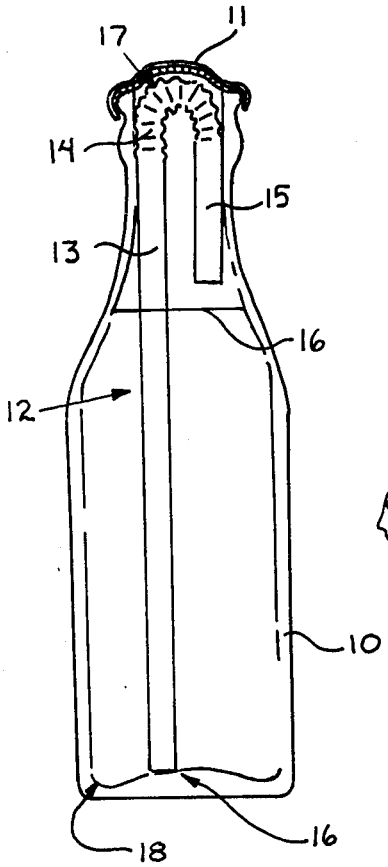
FIG. 1 is an illustration of the loaded straw within a bottle as in my previously referenced patent, U.S. Pat. No.: 3,746,197.
Figure 1A:
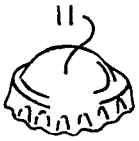
Figure 2A:
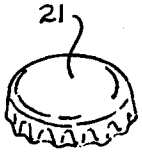
FIG. 2 is an illustration of a straw loaded into a bottle having a customary cap in the usual manner of straight loading.
Figure 2:
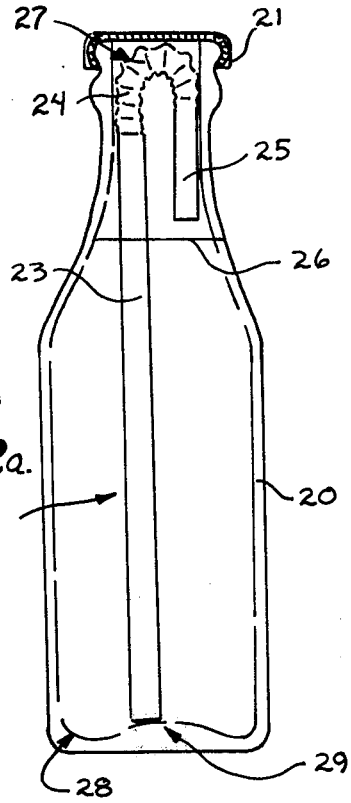

FIGS. 1 and 2 are shown purely for illustration of the use of this invention according to the prior art.

FIG. 1 shows a straw loaded in the manner as shown by my U.S. Pat. No. 3,746,197. This is a very satisfactory way to provide a straw utilizing a domed cap and utilizing a heretofore conceived means of straight loading of the straw into the bottle and leaving enough of the straw at the area 17 projecting above the top of the bottle after removal of the cap to allow easy removal for use.

The illustration of FIG. 1 shows particularly a bottle 10 having a domed cap 11 with the straw generally 12 loaded into the bottle which has a liquid level 16. The straw includes an elongated straight portion 13, a shorter straight portion 15, and a flexible section 14 with the small extension in the area 17 into the domed portion of the cap to allow for removal. The disadvantage of this is the necessity of the special domed cap arrangement. Such domed cap is possible on bottles but is more costly and is more particularly difficult in connection with other types of containers such as cans and cartons.

FIG. 2 shows the effect of a straw of this nature when placed into a bottle with a non-domed cap. A bottle 20 is illustrated having a liquid level at 26, and utilizing a customary straight crown-type cap or the like 21. In order to accomodate this with the straw loaded in customary manner, the straw generally 22 having its elongated portion 23, and shorter straight portion 25 is shown in loaded position, where it is obvious that the flexible portion 24 has no clearance above the top of the bottle at the area 27, since with a straight cap of any type this is not feasible. Thus, when so loaded, it is quite difficult to remove the straw, usually taking an instrument of some type to do so.

In the illustrations of both FIG. 1 and FIG. 2 it will be clear that had the straw been inserted directly down into the bottle as shown, under some type of pressure which would cause any spring-back, that in transport the straw will readily slip from the normally convex portion of the bottom 19 and 29 respectively and fall off to the side in such manner that even with my domed-shape cap, there may be malfunctions where the straw is not readily available for removal. The straw slipping into the depression around the edge 18 and 28 respectively will become unavailable. Even if the bottom of the bottle is flat it will still cause a problem when it slips out to the edge.

Figure 3:
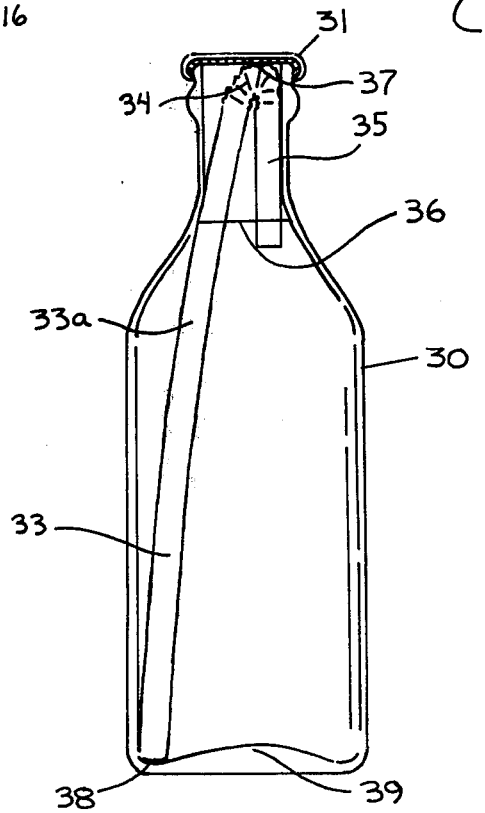
FIG. 3 is a schematic perspective of a bottle filling and straw loading apparatus suitable to the practice of this invention.

Turning attention now to FIG. 3 the straw within a bottle of similar construction to those shown in FIGS. 1 and 2 and having a flat cap is shown in the position of my new method and as inserted by the apparatus of this invention. It will be noted that the bottle 30 is of the same construction as bottles 10 and 20 in FIGS. 1 and 2, and in this case the cap 31 is the same as cap 21 of FIG. 2. The straw generally 22 is the same type straw having one elongated relatively rigid portion 33 and one shorter relatively rigid portion 35 with an intermediate flexible portion 34. The flexible portion will be similar to that customary in the art of flexible straws and will be understood to those skilled in the art.

In the example shown, the relatively rigid portion 33 of the straw has a slight bow at 33*a* due to pressure exerted by the cap against the end of the straw. The reference 36 is to show the approximate liquid level within the bottle. The reference 37 shows the flat customary underside of the cap 31. It will be observed that the elongated end of the straw 33 is bottomed in the corner edge of the bottle 38 and is not in any manner touching near the center 39. The relatively rigid end 35 is shown to be resting against the side of the bottle as indicated in FIG. 3 thus making it clear that even in transport and under difficult conditions the straw will not shift in its position and thus the flexible portion which can be gripped will not ever pass below the top of the bottle where it is slightly touching the cap. Even if no additional pressure causing the bow at 33*a* is used and if 33 is merely straight at no time does the straw disappear below an absolute flush position with the top of the cap and if the slight pressure is utilized, when the cap is removed the straw will bulge upward above the top of the cap.

It is thus noted that an important part of this method is the placing of a straw within a bottle at an angular relationship to the opening in such manner that the straw, without other physical restraint, retains its position so it does not move or become lost within the container.

Figures 4, 5, 6, 7, 8, 9:
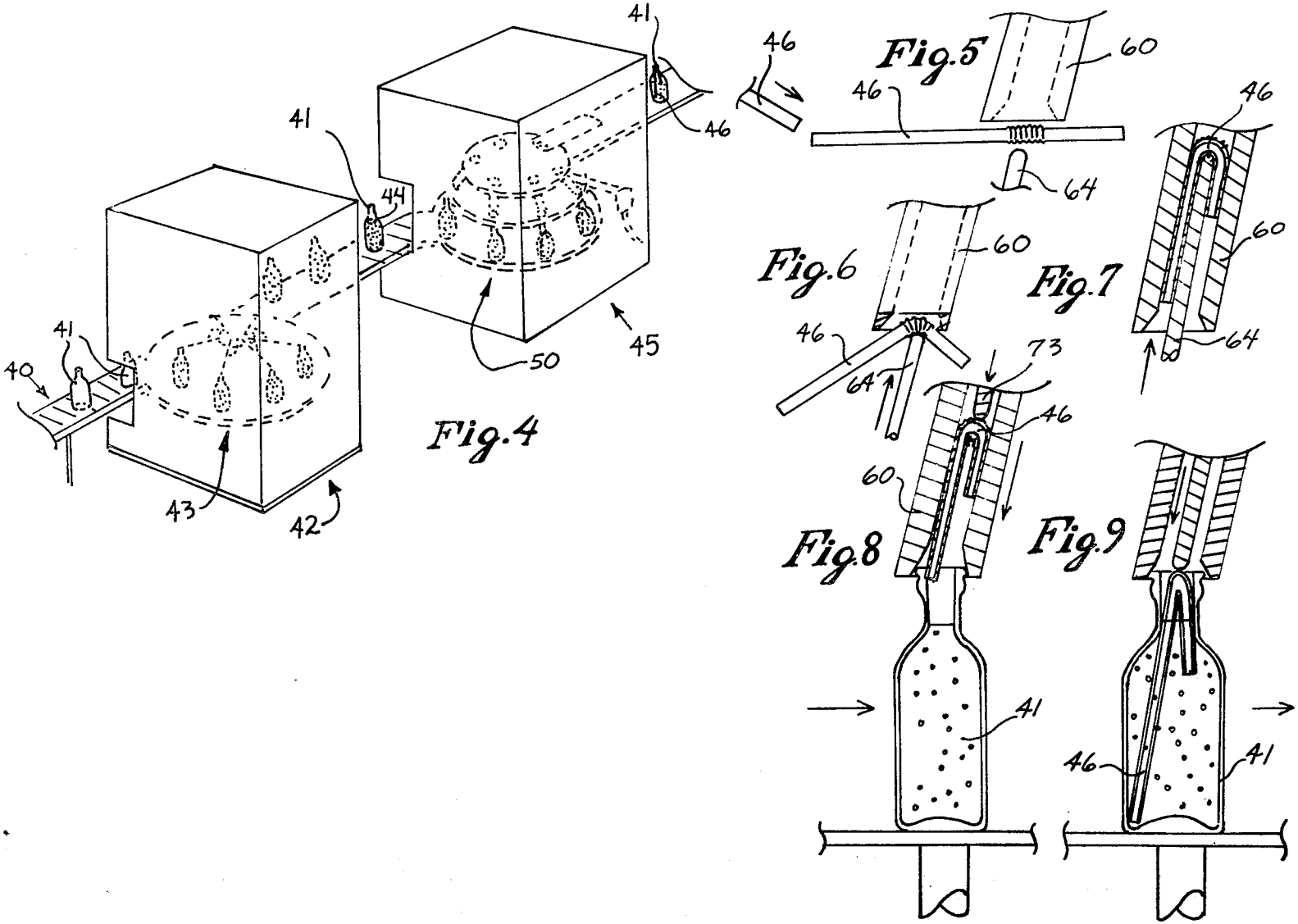
FIG. 4 is an enlarged schematic illustration of a straw loaded within a bottle by the method of this invention.
FIG. 5 illustrates the location of a straw about to be loaded into a device to be used in inserting the straw in the bottle in the method of this invention.
FIG. 6 is the same device and straw of FIG. 5 but showing partial insertion of the straw into the device.
FIG. 7 is a partial schematic section showing final loading of the straw into the dispensing device.
FIG. 8 is the same device of FIG. 7 now preparatory to expulsion into the bottle.
FIG. 9 is the same device and bottle of FIG. 8 showing the straw inserted into the bottle from the insertion device.

FIG. 4 is a schematic perspective illustration of a bottle filling line incorporating a mechanism for inserting the straw in each bottle without interrupting the flow through the line. A customary conveyor 40 is depicted with bottles 41 moving thereon and into the filling station 42 which customarily will have a turn-table arrangement upon which the bottles travel for filling, although not necessarily restricted to this. The mechanisms used for filling bottles will be understood by those skilled in the art. After emerging from the filling station, the bottles 41 will have liquid 44 therein. The bottles then proceed to straw inserting mechanism station 45 in which a straw inserting mechanism, preferably in the form of a turn-table arrangement 50, will be located. The turn-table arrangement 50 is illustrated in sufficient detail for one skilled in the art to manufacture the same in FIG. 10. After the bottle 41 leaves the straw filling station, the straw 46 will be seen to be located within each bottle. Thereafter the bottle will be capped by customary means known to those in the art.

Figure 10:
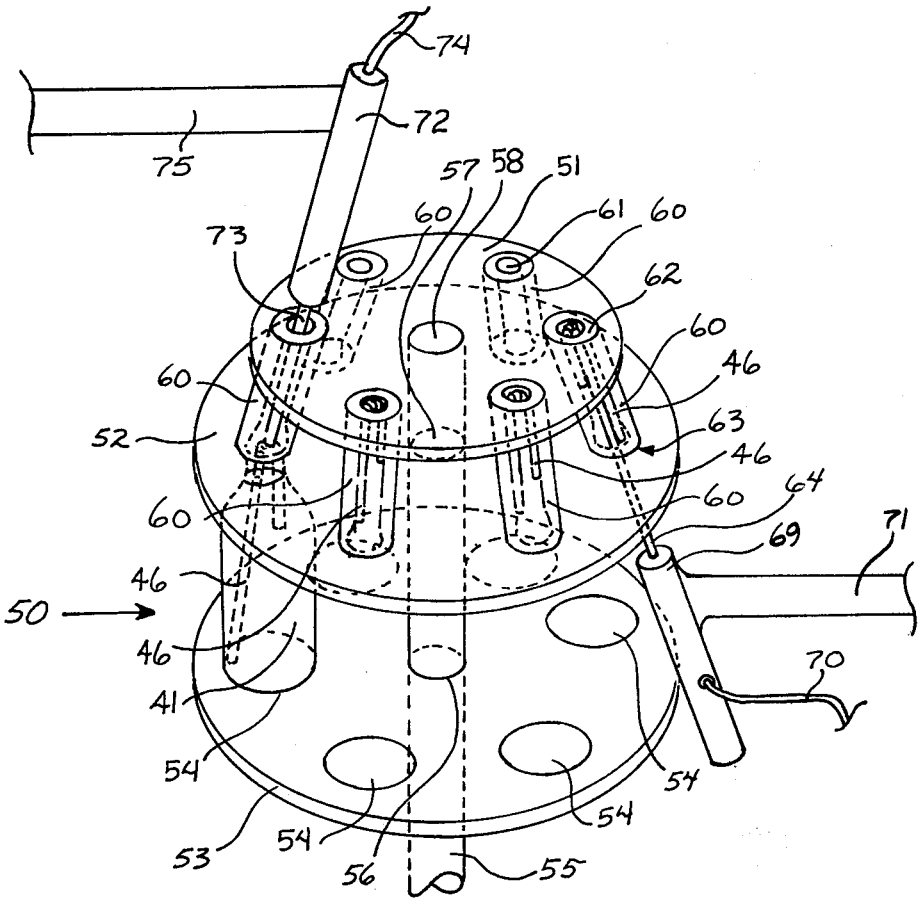
FIG. 10 is an enlarged schematic perspective, with certain elements in phantom, of a straw loading device suitable to the practice of this invention.

FIGS. 5, 6, 7, 8 and 9 show particularly various points in the insertion and removal of the straws in the entire machine which is outlined in FIG. 10. FIG. 10 will, therefore, be fully described first and thereafter the individual sequence of operation will be described with reference to FIGS. 5, 6, 7, 8 and 9. The overall mechanism 50 for inserting straws comprises a turn-table 53 having a number of bottle locations 54 which, preferably, will correspond to the number of locations in the filling machine 43.

There are two additional discs, 51 and 52, which are so disposed as to hold the straw holding cylinders 60. The three discs 51, 52 and 53 are fastoned to shaft 55 by means of appropriate welding or other fastening at 58, 57 and 56 respectively. Thus, the entire mechanism turns as a unit. Normally the shaft 55 will extend beneath the disc 53 and will be driven by appropriate motor or the like in a manner understood by those skilled in the art. One straw holding cylinder 60 will be disposed over each of the bottle holding locations 54. It will be observed that each straw holding cylinder 60 is composed of a hollow cylinder angularly disposed towards the location immediately above the neck of the bottle, each having a bore 61 suitable to hold the straw. Each of the straw holding cylinders will preferably have a somewhat conical shape lower end as indicated for facilitation of the feed of the straws into the device as well as to aid the expulsion in the desired manner.

As the first step in loading a straw into the straw holding device, a straw is fed by appropriate means known in the art to a holding device, such as a slide or the like, having suitable configurations so as to allow insertion of the straw as hereinafter described. The straw will then be lined up under the holding device 60 essentially as shown in FIG. 5, with the flexible portion immediately beneath the conical opening. In FIG. 6 the straw 46 is shown to be being pushed into the holding device 60 by pushrod 64 which is activated by cylinder 69, through appropriate activation means 70 which is connected to the activating energy source. In this step the straw is inserted so as to become in proper position for the later expulsion into the container. It will be understood that the full insertion is made in one stroke, but could, also, be partially inserted by one stroke and use a subsequent stroke for the final insertion. It is to be understood that the source of energy could be an air cylinder or hydraulic cylinder or solenoid, or the like. Thus the source of power might be compressed air, might be hydraulic fluid, or it might be electrical energy.

With attention given to FIG. 10, the straw insertion rod 64 activated by cylinder or the like 69 through energy means 70 is held in position by arm 71. Once again, this could be a solenoid operation, pneumatic, hydraulic, or other type operation as known to those skilled in the art.

FIG. 8 shows explicity the location of the straw 46 within holding cylinder 60 immediately positioned over a bottle 41 and ready for expulsion into the bottle.

With attention given to FIG. 9 and FIG. 10, for a description of the expulsion into the bottle, it will be observed that the straw 46 is expelled from the holding device by rod 73 activated by cylinder 72 which is held by suitable arm or the like 75 and in which activation energy 74 may once again be electrical, pneumatic, or hydraulic, or otherwise as may be desired.

Particularly it will be noted that by the expulsion of the straw in this manner, and with the conical shaped end of the holding device 60 the straw enters the bottle as shown particularly in FIG. 9 in such manner that the relatively rigid longer portion extends to the bottom at the outside edge and the shorter end of the straw presses firmly against the inner portion of the bottle thus holding the straw relatively in position.

When the cap is placed on the bottle, the straw cannot move in any direction, and if the straw has been given a slight amount of added length, it will be slightly bowed as indicated in the various drawings so as to exert an upward pressure when the bottle is opened thus making the straw easily available for withdrawal.

Figure 11:
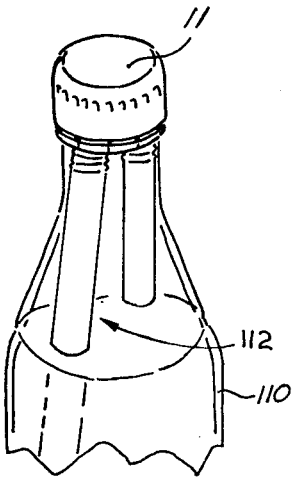
FIG. 11 is a perspective of the upper portion of a bottle with a straw loaded with a straw loaded by the method of this invention.
Figure 12:
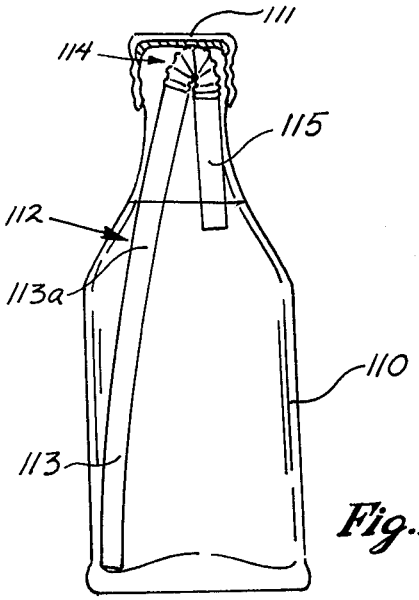
FIG. 12 is a side elevation of a bottle loaded with a straw by the method of this invention.

With attention turned to FIGS. 11 and 12 a bottle 110 having a screw type cap 111 with a flat upper surface is illustrated after having been filled in the method of this invention. The straw 112 is shown to have the one elongated relatively rigid portion 113 with a slight bow 113*a* from the pressure against the cap 111 against the flexible portion 114, with the other shorter relatively rigid portion pressing outwardly against the inner portion of the bottle as indicated particularly in FIG. 12.

Thus, it is clear, when the screw top is unscrewed, the straw will either move upwardly or in any event under no circumstances move below the top of the bottle.

Figure 13:
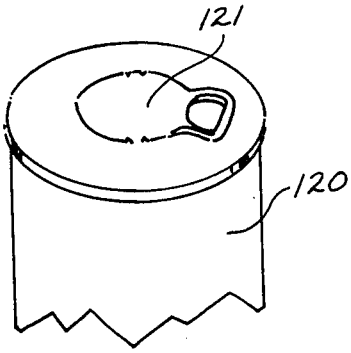
FIG. 13 is an upper partial perspective of a can in which a straw has been loaded by the method of this invention.
Figure 14:
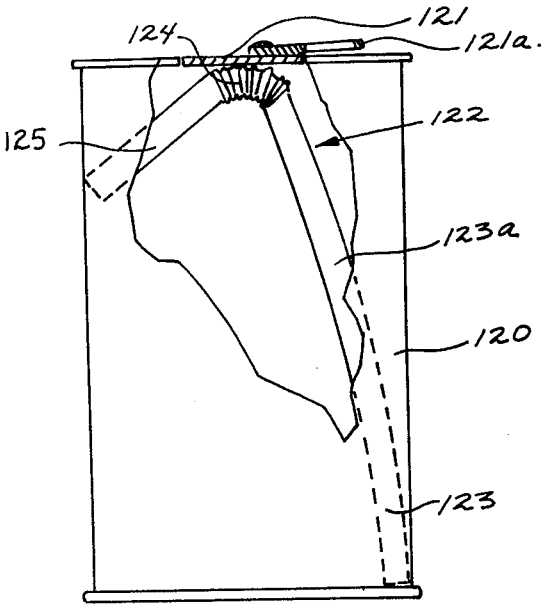
FIG. 14 is a partially broken away side elevation of the can of FIG. 13 showing the straw loaded by the method of this invention.

This same method and apparatus is adaptable to the filling of cans. FIGS. 13 and 14 illustrate a filled can in which a straw has been inserted in the method of this invention and with an apparatus similar to that shown for bottles in FIG. 10.

It will be observed that the can 120 has a center opening pull tab type closure 121 with tab 121*a* as is known in the art. With particular attention to FIG. 14 it will be observed that the straw 122 has its elongated, relatively stiff portion 123 adjacent to the inner edge of the can with its shorter relatively stiff portion 125 pressed out against the inner side of the can, and its flexible portion 124 located immediately beneath the closure preferably under slight pressure so as to provide a bowing action as at 123*a*. Again, it will be noted that when packed within a can in this manner, the straw will not move to an inaccessable location with the can and can be removed immediately upon the removal of the popped out opening 121.

Figure 15:
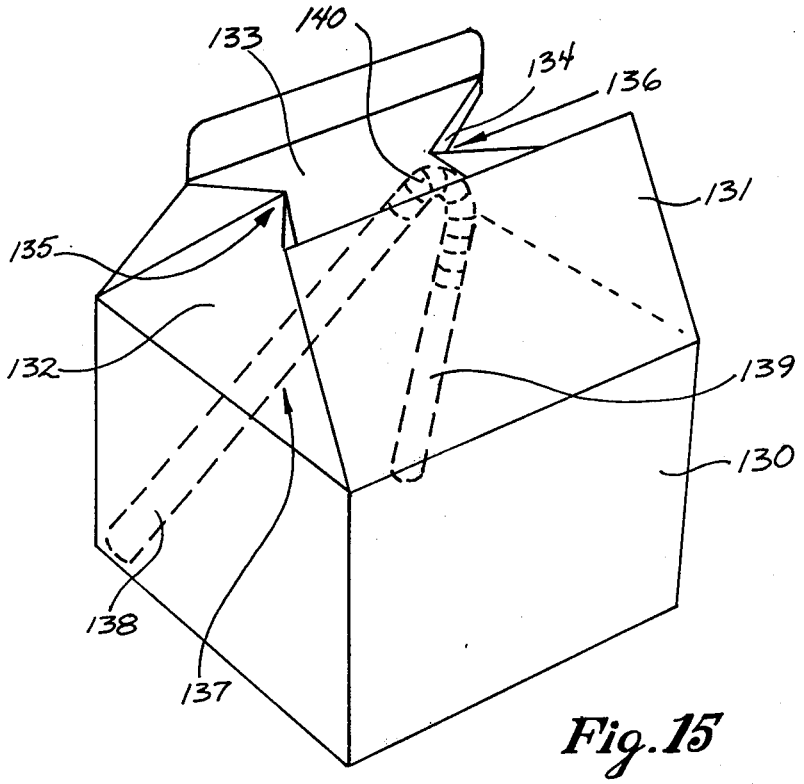
FIG. 15 is a perspective of a carton having a straw loaded by the method of this invention prior to sealing of the carton; and, FIG. 16 is an end elevation showing the location of the straw in phantom after having been loaded by the method of this invention.
Figure 16:
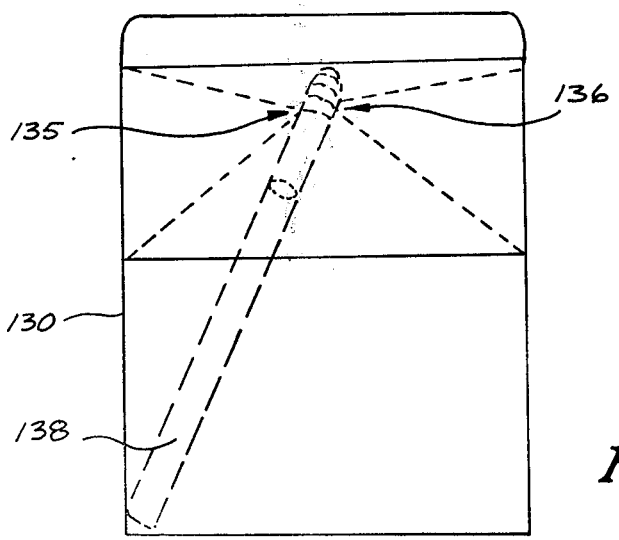

The versatility of this method and apparatus is further shown by the fact that it may be used effectively to place a straw even within a carton, such as a milk carton or the like. FIGS. 15 and 16 are illustrations of the location of a straw after insertion in a manner similar to that shown for insertion in a bottle in FIGS. 5 through 10. In the case of a carton 130 having top closure side 131, 132, 133 and 134, which close in customary manner by inward folding at 135 and 136 of two of the sides, the opened carton is first filled with milk or other fluid after which the straw 137 is inserted in the manner as indicated in drawings FIGS. 5 through 10. It is understood of course that in this case there will be cartons instead of bottles in the machinery but it will of similar nature as will be understood by those skilled in the art when they have understood the operation of the straw insertion method of a bottle. Immediately prior to final closing, the straw 137 will have the appearance within the carton 130 as indicated in FIG. 15. The end 138 will extend to one corner from which it cannot move due to the angular displacement of its end 139 against the carton together with the holding action of the folded ends at 135 and 136 as will be clear in viewing FIG. 16. Upon opening, then, the straw will be available for easy handling.

While the embodiments of this invention shown and described are fully capable of achieving the objects and advantages desired, it is to be understood that these embodiments are for purposes of illustration only and not for purposes of limitation.

I claim:

1. Apparatus for inserting a straw in a container comprising means to fold a straw comprising a flexible section with one elongated relatively rigid end and one relatively shorter relatively rigid end into a container comprising means to hold a straw; means to place said straw with its flexible portion in position to be received by the holder; means to insert said straw into said holder folded about the flexible portion so that the two relatively rigid ends are essentially parallel; means to align the straw holder with the opening of the container; means to eject the straw from the straw holder into said container; means cooperative with said means to eject and said means to hold the straw to spread said straw in such manner that the longer relatively rigid end is forced into contact with the lower end inner portion of the container and the shorter relatively rigid portion is forced into contact with another inner portion of the container.

2. The apparatus of claim 1 in which the means to insert the straw, includes means to insert the straw in such manner that a portion of the flexible part thereof extends above the open portion of the container and in which means are provided to close the container with closure means which forces the flexible portion of the straw downward in such manner that the relatively long straight portion is bowed.

* * * * *